US007669779B2

(12) United States Patent
Young

(10) Patent No.: US 7,669,779 B2
(45) Date of Patent: Mar. 2, 2010

(54) RAIL CLIP SUPPORT SHOULDER

(75) Inventor: Hartley Frank Young, Melton (AU)

(73) Assignee: AirBoss Railway Products Inc., Kansas City, MO (US)

( * ) Notice: Subject to any disclaimer, the term of this patent is extended or adjusted under 35 U.S.C. 154(b) by 381 days.

(21) Appl. No.: 11/729,361

(22) Filed: Nov. 30, 2006

(65) Prior Publication Data

US 2007/0210179 A1 Sep. 13, 2007

(30) Foreign Application Priority Data

Dec. 9, 2005 (AU) ..... 2005906916

(51) Int. Cl.
*E01B 9/30* (2006.01)

(52) U.S. Cl. ..... 238/310

(58) Field of Classification Search ..... 238/269, 238/270, 310, 315, 321, 338, 351
See application file for complete search history.

(56) References Cited

U.S. PATENT DOCUMENTS 5,110,046 A * 5/1992 Young ..... 238/283
5,520,330 A 5/1996 Brown et al.
5,551,633 A 9/1996 Kish et al.
6,367,704 B1 * 4/2002 Mediavilla ..... 238/310
6,604,690 B2 * 8/2003 Young ..... 238/270

FOREIGN PATENT DOCUMENTS

WO WO-0231264 4/2002

* cited by examiner

*Primary Examiner*—S. Joseph Morano
*Assistant Examiner*—Robert J McCarry, Jr.
(74) *Attorney, Agent, or Firm*—Connolly Bove Lodge & Hutz LLP

(57) ABSTRACT

Improved rail clip support shoulders are less expensive than conventional shoulders. The rail seat includes a concrete rail tie; a pair of rail clip support shoulders cast in place in said rail tie each said shoulder having a rail face between its external sides; a pair of shoulder insulators each shaped to lie against the rail face of the rail shoulder; a pair of rail clips each having a base section adapted to seat within the rail clip support shoulder and a toe section adapted to seat on the rail base, the toe section comprising a pair of bifurcated arms extending from said base section and being bent in a curve so that the toes lie adjacent but beyond the base; the arrangement being such that the clamping force exerted by each installed clip is at least 8 kilonewtons and the leading edge of the base section of the rail clip first engages a loading incline on either side of the rail clip ramp, while the line of contact of the trailing edge of base section is on the concrete rail tie and the trailing edge does not contact the rail clip ramp in the support shoulder until at least 40% of the distance to fully install the clamp has been traveled.

3 Claims, 3 Drawing Sheets

RAIL CLIP SUPPORT SHOULDER

CROSS REFERENCE TO RELATED APPLICATION

This Nonprovisional application claims priority under 35 U.S.C. §119(a) on Patent Application No. 2005906916 filed in Australia on Dec. 9, 2005, the entire contents of which are hereby incorporated by reference.

TECHNICAL FIELD

This invention relates to a rail fastening assembly of the type where a rail is clamped to a rail seat by elastic rail fasteners held in shoulders fastened to the tie and insulators isolate the rail fastener and support shoulders from the rail. The present invention addresses problems associated with the insulators.

BACKGROUND

Concrete ties have been in use in some parts of the world for a long time but it is only since 1985 that they have been able to provide cost benefits for use in North America relative to wooden ties.

One advantage of concrete ties is that the rail seats can be pre assembled with only a few components to be added on site when the rail is placed in position. The difficulty with this is that the pre assembled components can become dislodged during transport and some components still have to be positioned on the rail. The rail seats usually comprises a rail pad that is positioned below the rail, an abrasion resistant plate below the pad, rail clip support shoulders on the field and gauge sides of the rail, an elastic rail clip that seats in the support shoulder and bears down on the rail base and an insulator that lies between the rail and the rail clip and the support shoulder. The support shoulders are precast in the rail tie and the rail pad is fitted between each pair. Because the rail clips and insulators contact the rail when fastened they cannot be placed in position until the rail has been placed in position on the rail seat. Rail seat assemblies of this type have been generally described in U.S. Pat. Nos. 5,110,046, 5,551,633 and 6,604,690. The rail clips in these assemblies are either installed or loose and therefore had to be assembled on site. U.S. Pat. No. 6,367,704 proposed using a modified support shoulder so that the clip could be partially installed for transport purposes where it was retained on the shoulder and then able to be fully installed when the rail was placed in position. In this arrangement the insulators still needed to be placed in position manually before the clip could be fully installed. U.S. Pat. No. 5,520,330 discloses a bent rod rail clip with a two part insulator that enables the rail seat to be pre-assembled at the tie plant.

WO02/31264 discloses a rail clip that has an insulator encapsulating the toe of the rail clip that lies on the rail flange to avoid the need to insert the insulator separately.

One concern with concrete rail ties is the cost and it is desirable to reduce the cost of the assembled rail tie. One significant component in the cost of the rail tie is the clip support shoulder embedded in the concrete rail tie. This support shoulder needs to be durable and capable of withstanding the forces applied by the rail clip. The rail clip applies a high clamping force of 8 to 13 kilonewtons and this force is achieved by gradually displacing the toe of the clip from the base by driving the clip horizontally along a loading surface in the support shoulder. The clip reaction against the base of the support shoulder is very high and approaches pressures where metal pickup occurs. The force required to fit the clip is usually inversely linked to the length the clip travels within the shoulder. Thus the support shoulders are usually large to reduce the force needed to apply the clips and the size of the shoulders is proportional to their cost. When the support shoulders are designed to accept preloaded clips, as part of a partly assembled rail seat prior to the rail being fitted, extra travel distance is required because in the preloaded position the toe of the clip must be clear of the rail. This additional length increases the size and cost of the support shoulders.

It is an object of this invention to provide a rail clip shoulder that is less expensive and enables easier assembly of a rail seat with high clamping forces without compromising rail fastening performance.

SUMMARY OF THE INVENTION

To this end the present invention provides a railroad tie and rail seat assembly for supporting a rail which included a) a concrete rail tie b) a pair of rail clip support shoulders cast in place in said rail tie each said shoulder having a rail face between its external sides, a clip gateway through said rail face, a rail clip ramp leading from the rear of the shoulder and terminating in the clip gateway at substantially the level of the rail base and a loading incline on either side of the rail clip ramp which incline is directed downwardly from the rear of the shoulder toward the clip gate way;

c) a rail pad seated on said rail tie between said support shoulders d) a pair of shoulder insulators each shaped to lie against the rail face of the rail shoulder;

e) a pair of rail clips each having a base section adapted to seat within the rail clip support shoulder and a toe section adapted to seat on the rail base, the toe section comprising a pair of bifurcated arms extending from said base section and being bent in a curve so that the toes lie adjacent but beyond the base section f) the arrangement being such that the clamping force exerted by each installed clip is at least 8 kilonewtons and the leading edge of the base section of the rail clip first engages a loading incline on either side of the rail clip ramp, while the line of contact of the trailing edge of base section is on the concrete rail tie and the trailing edge does not contact the rail clip ramp in the support shoulder until at least 40% of the distance to fully install the clamp has been traveled.

This invention provides additional travel distance for the clip without increasing the length and cost of the shoulders. By arranging for the concrete surface of the rail tie to carry the vertically downward force at the rear of the clip base in the early stages of the clip application the shoulder can be reduced in size and therefore becomes less costly. During the early stages of clip application the forces are low enough to be carried by the concrete without causing any damage. This force is transferred from the concrete to the metal of the support shoulder before the maximum force that can be borne by the concrete is reached. Preferably the transfer occurs at about 50% of the total distance traveled by the rail clip within the support shoulder.

The support shoulder is inclined to the horizontal and the clip ramp is also upwardly inclined so that the trailing edge of the clip base moves upwardly away from the concrete tie surface as the clip is driven to its final position.

DETAILED DESCRIPTION OF THE INVENTION

A preferred embodiment of the invention will now be described with reference to the drawings in which FIG. 1 is a detail of a plan view illustrating one embodiment of this invention;

Figure 1:
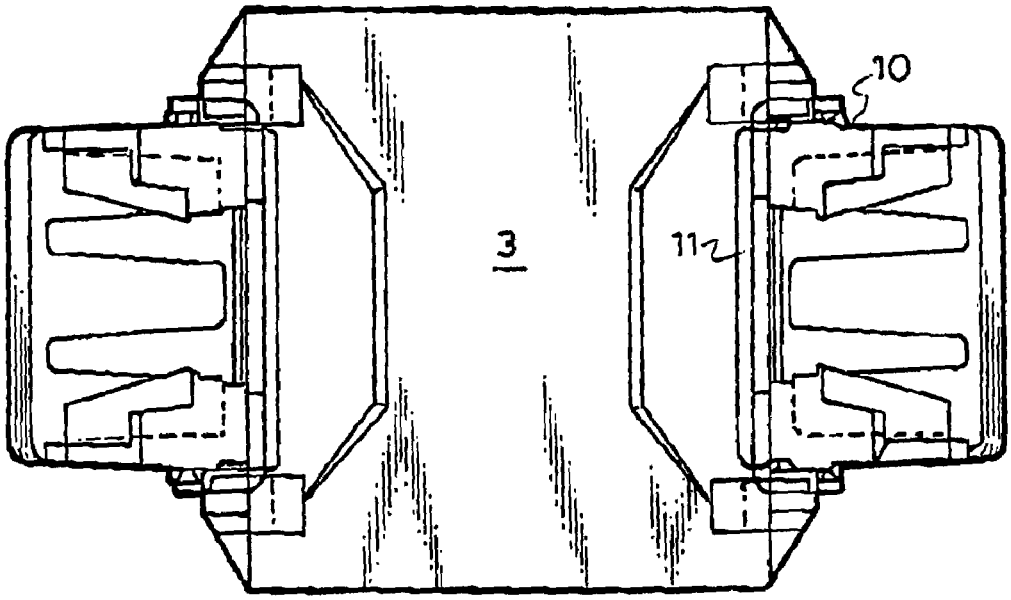
Figure 2:
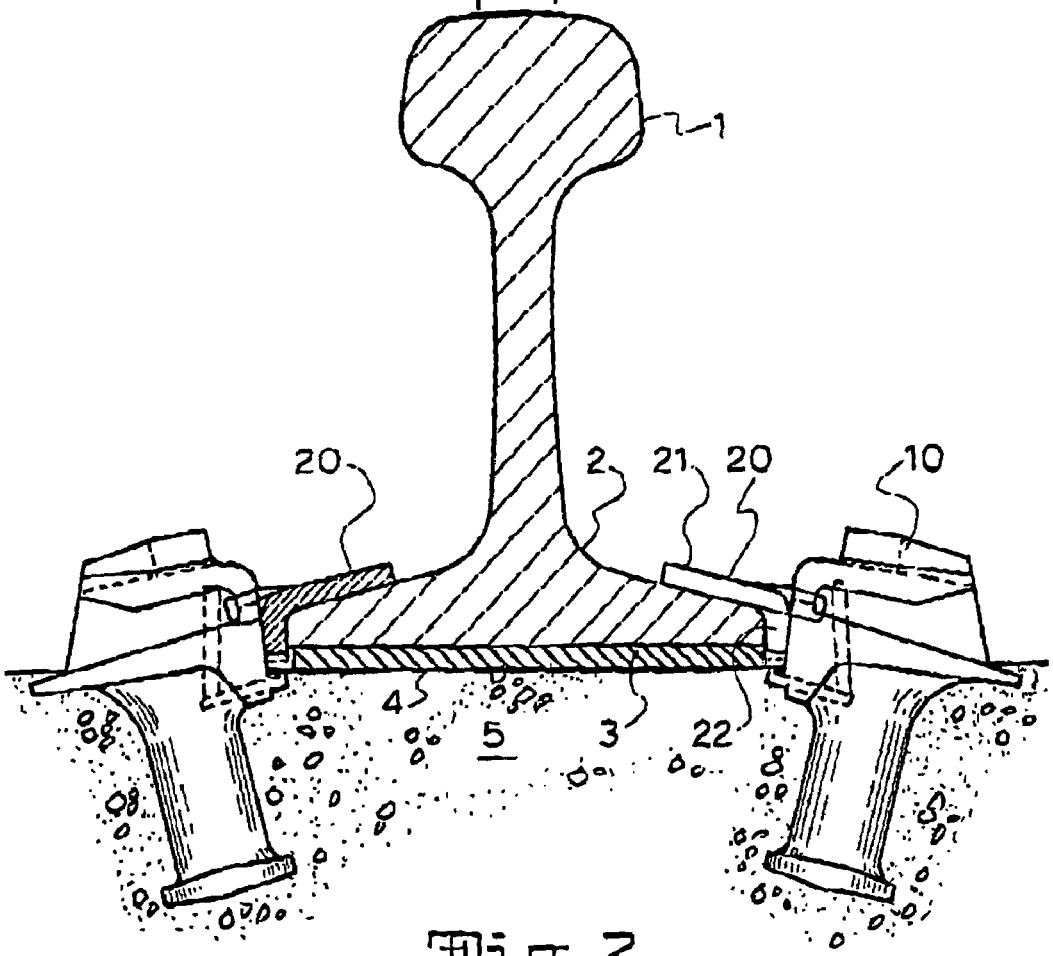
FIG. 2 is a side elevation of a typical rail seat of this invention without a rail clip.
Figure 3:
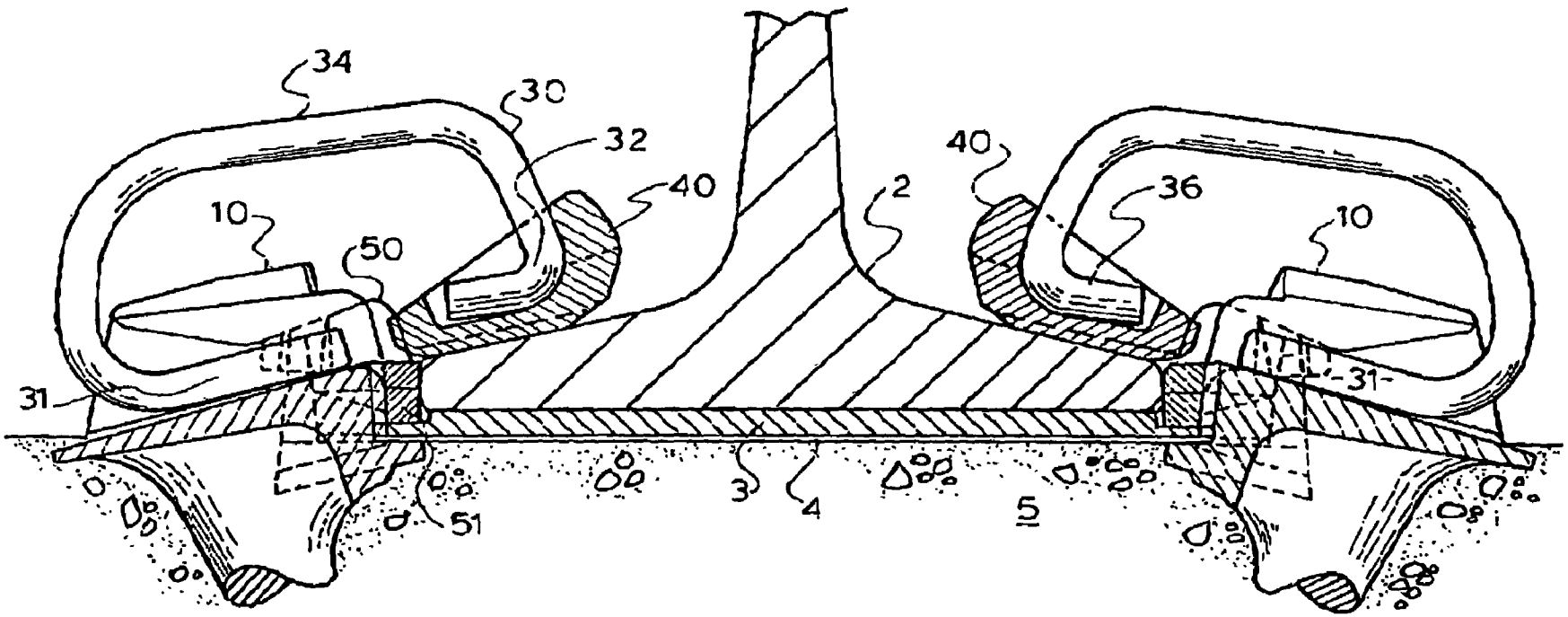
FIG. 3 is a side view of an alternative assembly loaded with a rail clip.

The rail seat comprises a concrete rail tie 5 into which has been cast the rail clip support shoulders 10. Between the two shoulders 10 are positioned a rail pad 3 and beneath that a wear resisting plate 4. The rail 2 seats on the rail pad 3. This rail pad may incorporate a recess at its edge adjacent the shoulder 10 to accommodate a combined shoulder and rail insulator 20 as shown in FIG. 2. The rail pad is preferably as described in Australian specification 2004201448. In FIG. 3 the base 31 of rail clip 30 is securely held within the shoulder 10 and the toe section 32 seats within the toe insulator 40 that lies on the rail base 2. The deep post insulator 50 is attached to shoulder 10 and lies between the rail base 2 and the shoulder 10 and extends down to the rail pad 3.

Figure 4:
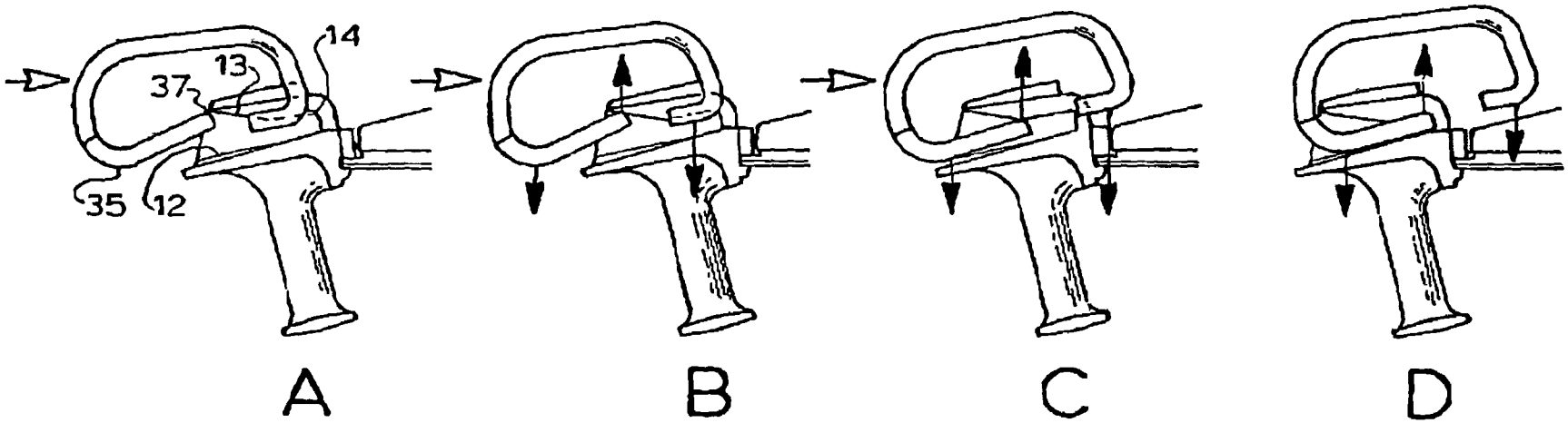
FIG. 4 illustrates 4 stages in the loading of the rail clip to the support shoulder.

The rail clip 30 as illustrated in FIGS. 3 and 4 is made from a flat metal stamping bent into its final 3 dimensional state. Rail clips of this kind are known from U.S. Pat. No. 6,637,704. The rail clip consists of a base web 31 which bifurcates into arms 34 that end in the toe portions 32. The ends 36 of the toe portion 32 are shaped to enable to clips to be held in a partially applied position in the shoulder 10. The rail clip and shoulder are designed so that the clip has two stable positions in the shoulder namely a preloaded position where a rail can be placed in position on the rail seat and a fully loaded position in which the toes of the rail clip are on the rail base.

The angled base of the installed shoulder and the angle of the clip base in the shoulder are chosen so that the frictional engagement of the clip base keeps the clip located on the rail base. As the clip is applied to the shoulder the leading edge 37 of the base of the rail clip engages the loading incline 13 of the shoulders 10. The trailing edge 35 of the base of the rail clip initially lies on the concrete surface of the rail tie 3 and then moves up the rail clip ramp 12 of the shoulder 10. In the fully loaded position the leading edge 37 is held in place in the holding slot 14 of the shoulder 10.

As shown in FIG. 4 the length of the support shoulder is reduced in length by about half the distance traveled by the clip as it is applied to the shoulder.

As shown in FIG. 4A when the clip first engages the shoulder the leading edge 37 engages the loading incline 13 and the trailing edge 35 slides across the surface of the concrete tie 3. This is shown in FIG. 4B which is a stable park position, suitable for transport of the assembled rail seat. As the leading edge 37 moves into the interior of shoulder 10 it is pushed down by the incline 13 and this increases the reaction force of trailing edge 35 on the concrete tie 3. As the leading edge 37 approaches the end of incline 13 the trailing edge 35 passes onto the ramp 12 of shoulder 10 as shown in FIG. 4C which is the stage at which high loading of the clip commences. In the fully loaded position as shown in FIG. 4D the leading edge 37 is held down by the holding slot 14.

Those skilled in the art will realize that the present invention provides a rail tie assembly that is easy to fabricate and assemble and is inexpensive. Although one particular embodiment has been described, those skilled in the art will realize that variations and modifications may be made without departing from the core teachings of the invention.

What is claimed is:

1. A railroad tie and rail seat assembly for supporting a rail which includes a) a concrete rail tie;

b) a pair of rail clip support shoulders cast in place in said rail tie, each said shoulder having an anchor encased below the top surface of the concrete, a rail clip receiving section located substantially above the concrete surface, wherein both shoulder sections are coaxial, the common axis therebetween positioned at an incline relative to the concrete tie surface; each shoulder further having a rail face between its external side, a clip gateway through said rail face, a rail clip ramp inclined due to the inclination of the support shoulder and leading from the rear of the shoulder and terminating in the clip gateway at substantially the level of the rail base and a loading incline on either side of the rail clip ramp which incline is directed downwardly from the rear of the shoulder toward the clip gate way;

c) a rail pad seated on said rail tie between said support shoulders;

d) a pair of shoulder insulators each shaped to lie against the rail face of the rail shoulder;

e) a pair of rail clips each having a base section adapted to seat within the rail clip support shoulder and a toe section adapted to seat on the rail base, the toe section comprising a pair of bifurcated arms extending ending from said base section and being bent in a curve so that the toes lie adjacent but beyond the base section; and f) the arrangement being such that the clamping force exerted by each installed clip is at least 8 kilonewtons, and when the rail clip is in a parked position, the leading edge of the base section of the rail clip engages a loading incline on either side of the rail clip ramp while the line of contact of the trailing edge of the base section is on the concrete rail tie, wherein the trailing edge does not contact the rail clip ramp in the support shoulder until at least 40% of the distance between the parked position and a fully installed position for the rail clip has been traveled.

2. A rail road tie and rail seat as claimed in claim 1 in which the trailing edge of the clip does not contact the support shoulder ramp until about 50% of the distance to fully install the clamp has been traveled.

3. A support shoulder as claimed in claim 1 in which the length of the ramp in the support shoulder is about half of the distance traveled by the rail clip when driven onto the rail.

* * * * *